US005510008A

United States Patent [19]

Sekhar et al.

[11] Patent Number: 5,510,008

[45] Date of Patent: Apr. 23, 1996

[54] STABLE ANODES FOR ALUMINIUM PRODUCTION CELLS

[76] Inventors: Jainagesh A. Sekhar, 2310 E. Hill Ave., Cincinnati, Ohio 45208; James J. Liu, 506 Riddle Rd., Cincinnati, Ohio 45220; Jean-Jacques Duruz, Rue de Hesse 4, 1204 Geneva, Switzerland

[21] Appl. No.: 327,322

[22] Filed: Oct. 21, 1994

[51] Int. Cl.[6] ..... C25C 3/12

[52] U.S. Cl. ..... 205/384; 204/290 R; 205/231

[58] Field of Search ..... 204/290 R, 67; 205/316, 320, 324, 325, 333, 230, 231; C25C 3/06, 3/08, 3/10, 3/12

[56] References Cited

U.S. PATENT DOCUMENTS

| | | | |
|---|---|---|---|
| 4,374,050 | 2/1983 | Ray | 252/519 |
| 4,374,761 | 2/1983 | Ray | 252/519 |
| 4,454,015 | 6/1984 | Ray et al. | 204/293 |
| 4,614,569 | 9/1986 | Duruz et al. | 204/67 |
| 4,620,905 | 11/1986 | Tarcy et al. | 204/64 R |
| 4,678,760 | 7/1987 | Ray | 501/96 |
| 4,909,842 | 3/1990 | Dunmead et al. | 75/236 |
| 4,948,676 | 8/1990 | Darracq et al. | 428/539.5 |
| 4,956,068 | 9/1990 | Nguyen et al. | 204/242 |
| 4,960,494 | 10/1990 | Nguyen et al. | 204/67 |
| 5,069,771 | 12/1991 | Nguyen et al. | 204/290 R |
| 5,217,583 | 6/1993 | Sekhar et al. | 204/67 |
| 5,284,562 | 2/1994 | Beck et al. | 204/243 R |
| 5,316,718 | 5/1994 | Sekhar | 419/19 |
| 5,340,448 | 8/1994 | Sekhar et al. | 204/67 |

FOREIGN PATENT DOCUMENTS

US9303605 10/1994 WIPO .

*Primary Examiner*—Kathryn Gorgos

[57] ABSTRACT

An anode for the electrowinning of aluminium by the electrolysis of alumina dissolved in a molten fluoride electrolyte comprises a porous combustion synthesis product of nickel, aluminium, iron, copper and optional doping elements in the amounts 60–90 wt % nickel, 3–10 wt % aluminium, 5–20 wt % iron, 0–15 wt % copper and 0–5 wt % of one or more of chromium, manganese, titanium, molybdenum, cobalt, zirconium, niobium, yttrium, cerium, oxygen, boron and nitrogen. The combustion synthesis product contains metallic and intermetallic phases. A composite oxide surface is produced in-situ by anodic polarization of the porous combustion synthesis product in a molten fluoride electrolyte containing dissolved alumina. The in-situ formed composite oxide surface comprises an iron-rich relatively dense outer portion, and an aluminate-rich relatively porous inner portion.

15 Claims, No Drawings

STABLE ANODES FOR ALUMINIUM PRODUCTION CELLS

FIELD OF THE INVENTION

This invention relates to anodes for the electrowinning of aluminium by the electrolysis of alumina in a molten fluoride electrolyte, in particular cryolite.

The invention is more particularly concerned with the production of anodes of aluminium production cells made of composite materials by the micropyretic reaction of a mixture of reactive powders, which reaction mixture when ignited undergoes a micropyretic reaction to produce a net-shaped reaction product.

BACKGROUND ART

U.S. Pat. No. 4,614,569 describes anodes for aluminium electrowinning coated with a protective coating of cerium oxyfluoride, formed in-situ in the cell or pre-applied, this coating being maintained by the addition of cerium to the molten cryolite electrolyte.

U.S. Pat. No. 4,948,676 describes a ceramic/metal composite material for use as an anode for aluminium electrowinning particularly when coated with a protective cerium oxyfluoride based coating, comprising mixed oxides of cerium and one or more of aluminium, nickel, iron and copper, in the form of a skeleton of interconnected ceramic oxide grains interwoven with a metallic network of an alloy or an intermetallic compound of cerium and one or more of aluminium, nickel, iron and copper.

U.S. Pat. No. 4,909,842 discloses the production of dense, finely grained composite materials with ceramic and metallic phases by self-propagating high temperature synthesis (SHS) with the application of mechanical pressure during or immediately after the SHS reaction.

U.S. Pat. No. 5,217,583 describes the production of ceramic or ceramic-metal electrodes for electrochemical processes, in particular for aluminium electrowinning, by combustion synthesis of particulate or fibrous reactants with particulate or fibrous fillers and binders. The reactants included aluminium usually with titanium and boron; the binders included copper and aluminium; the fillers included various oxides, nitrides, borides, carbides and silicides. The described composites included copper/aluminium oxide-titanium diboride etc.

PCT patent application No. WO92/22682 describes an improvement of the just mentioned production method with specific fillers. The described reactants includes an aluminium nickel mixture, and the binder could be a metal mixture including aluminium, nickel and up to 5 weight % copper.

U.S. Pat. No. 4,374,050 and 4,374,761 disclose anodes for aluminium electrowinning composed of a family of metal compounds including oxides. It is stated that the anodes could be formed by oxidizing a metal alloy substrate of suitable composition. However, it has been found that oxidized alloys do not produce a stable, protective oxide film but corrode during electrolysis with spalling off of the oxide. U.S. Pat. No. 4,620,905 also discloses oxidized alloy anodes.

U.S. Pat. Nos. 4,454,015 and 4,678,760 disclose aluminium production anodes made of a composition material which is an interwoven network of a ceramic and a metal formed by displacement reaction. These ceramic metal composites have not been successful.

U.S. Pat. Nos. 4,960,494 and 4,956,068 disclose aluminium production anodes with an oxidized copper-nickel surface on an alloy substrate with a protective barrier layer. However, full protection of the alloy substrate was difficult to achieve.

U.S. Pat. No. 5,284,562 discloses alloy anodes made by sintering powders of copper nickel and iron. However, these sintered alloy anodes cannot resist electrochemical attack.

PCT published application patent No. WO94/24321, as yet unpublished, discloses aluminium production anodes comprising ordered aluminide compounds of nickel, iron and titanium produced by micropyretic reaction with a cerium-based colloidal carrier.

So far, all attempts to produce an electrode suitable as anode for aluminium production and based on metals such as nickel, aluminium, iron and copper or other metals have proven to be unsuccessful in particular due to the problem of poor adherence due partly to thermal mismatch between the metals and the oxide formed prior to or during electrolysis.

SUMMARY OF THE INVENTION

An object of the invention is to provide an anode for aluminium production where the problem of poor adherence due partly to thermal mismatch between a metal substrate and an oxide coating formed from the metal components of the substrate is resolved, the metal electrode being coated with an oxide layer which remains stable during electrolysis and protects the substrate from corrosion by the electrolyte.

The invention provides an anode for the production of aluminium by the electrolysis of alumina in a molten fluoride electrolyte, comprising a porous combustion synthesis product deriving from particulate nickel, aluminium and iron, or particulate nickel, aluminium, iron and copper, optionally with small quantities of doping elements, containing metallic and/or intermetallic phases, and an in-situ formed composite oxide surface produced by anodically polarizing the combustion synthesis product in a molten fluoride electrolyte containing dissolved alumina. The in-situ formed composite oxide surface comprises an iron-rich relatively dense outer portion, and an aluminate-rich relatively porous inner portion.

Comparative anodes of similar composition but prepared from alloys not having a porous structure obtained by combustion synthesis show poor performance. This is believed to be a result of the mismatch in thermal expansion between the oxide layer and the metallic substrate with the alloy anodes. The differences in thermal expansion coefficients allow cracks to form in the oxide layer, or result in the complete removal of the oxide layer from the alloy, which induces corrosion of the anode by penetration of the bath materials, leading to short useful lifetime.

In contrast, the porous anodes according to the invention accommodate the thermal expansion, leaving the dense protective oxide layer intact. Bath materials such as cryolite which may penetrate the porous metal during formation of the oxide layer become sealed off from the electrolyte, and from the active outer surface of the anode where electrolysis takes place, and do not lead to corrosion but remain inert inside the electrochemically-inactive inner part of the anode.

The composition of the combustion synthesis product is important to produce formation of a dense composite oxide surface comprising an iron-rich relatively dense outer portion and an aluminate-rich relatively porous inner portion by diffusion of the metals/oxides during the in-situ production of the oxide surface.

The combustion synthesis product is preferably produced from particulate nickel, aluminium, iron and copper in the amounts 60–90 wt % nickel, 3–10 wt % aluminium, 5–20 wt % iron and 0–15 wt % copper, and the particulate nickel may advantageously have a large particle size than the particulate aluminium, iron and copper. Additive elements such as chromium, manganese, titanium, molybdenum, cobalt, zirconium, niobium, yttrium, cerium, oxygen, boron and nitrogen can be included as "dopants" in a quantity of up to 5 wt % in total. Usually, these additional elements will not account for more than 2 wt % in total.

More preferably still, the combustion synthesis product is produced from 60–67 wt % nickel, 3–10 wt % aluminium, 5–20 wt % iron and 5–15 wt % copper.

With the aluminium content in the preferred range 3–10 wt %, the resulting composition has good adherence with cerium oxyfluoride coatings when such coatings are used for protection, and the lowest corrosion rate. Below 3% aluminium, the composites still have low corrosion, but surface spalling is found after testing. With increasing aluminium content above 10 wt %, corrosion increases, and above about 13 wt % aluminium, the composites have low porosity due to the increase of combustion temperature.

With below 5 wt % iron or no iron, the samples have higher corrosion and a non-conducting layer is found after testing. Above 20 wt % iron, results in surface spalling after oxidation, 15 wt % being a preferred upper limit.

Below 5 wt % copper down to 0 wt % copper results in anodes with higher corrosion but rate which are nevertheless acceptable, and more than 15 wt %, in particular more than 20 wt % copper, results in surface spalling after oxidation. When copper is present, it has been found that the composite oxide layer is depleted in copper, whereas the unoxidized portion of the combustion synthesis product adjacent to the aluminate rich inner portion of the oxide surface is rich in copper.

It is preferred to use very reactive iron and copper, by selecting a small particle size of 44 micrometers or less for these components.

It is recommended to use aluminium particles in the size range 5 to 20 micrometers. Very large aluminium particles (−100 mesh) tend to react incompletely. Very fine aluminium particles, below 5 micrometers, tend to have a strong oxidation before the micropyretic reaction, which may result in corrosion when the finished product is used as anode.

It is recommended to use nickel with a large particle size, for example up to about 150 micrometers. Fine nickel particles, smaller than 10 micrometers, tend to lead to very fine NiAl, $Ni_3Al$ or $NiO_x$ particles which may increase corrosion when the finished product is used as anode. Using large nickel particles enhances the formation of Ni-Al-O, Ni-Cu-Al-O, Ni-Al-Fe-O or Fe-Al-O phase on the surface which inhibits corrosion, and also promotes a porous structure. However, good results have also been obtained with nickel particles in the range 10 to 20 micrometers; these small nickel particles leading to a finer and more homogeneous porous microstructure.

The powder mixture may be compacted by uniaxial pressing or cold isostatic pressing (CIP), and the micropyretic reaction may be ignited in air or under argon. Excellent results have been obtained with combustion in air.

The powder mixture is preferably compacted dry. Liquid binders may also be used.

The micropyretic reaction (also called self-propagating high temperature synthesis or combustion synthesis) can be initiated by applying local heat to one or more points of the reaction body by a convenient heat source such as an electric arc, electric spark, flame, welding electrode, microwave or laser; in which case, the reaction propagates through the reaction body along a reaction front which may by self-propagating or assisted by a heat source, as in a furnace. Reaction may also be initiated by heating the entire body to initiate reaction throughout the body in a thermal explosion mode. The reaction atmosphere is not critical, and reaction can take place in ambient conditions without the application of pressure.

The combustion synthesis product has a porous structure comprising at least two metallic and/or intermetallic phases. Generally, the combustion synthesis product comprises at least one intermetallic compound from the group consisting of nickel-iron, nickel-aluminium, aluminium-iron, nickel-aluminium-copper and nickel-aluminium-iron-copper containing intermetallic compounds The porosity and micro-structure of the combustion synthesis product as important for the in-situ formation of the surface oxide layer since the pores accommodate for thermal expansion, leaving the outer oxide layer intact during electrolysis.

The porous combustion synthesis product may comprise nickel aluminide in solid solution with copper, and possibly also in solid solution with other metals and oxides. Another material comprises a major amount of $Ni_3Al$ and minor amounts of NiAl, nickel, and a ternary nickel-aluminium-copper intermetallic compound.

Other porous combustion synthesis products comprise at least one intermetallic compound from the group AlNi, $AlNi_3$, $Al_3Fe$, $AlFe_3$ as well as ternary or quaternary intermetallic compounds derived therefrom, and solid solutions and mixtures of at least one of said intermetallic compounds with at least one of the metals nickel, aluminium, iron and copper.

Another porous combustion synthesis product comprises an intimate mixture of at least one intermetallic compound of nickel-aluminium, at least one intermetallic compound of nickel-aluminium-copper, copper oxide, and a solid solution of at least two of the metals nickel, aluminium and copper.

The porous combustion synthesis product may comprise an intimate mixture of at least one intermetallic compound of nickel-aluminium such as $Ni_3Al$ and $Al_3Ni$, at least one intermetallic compound of nickel-aluminium-copper such as $Al_{73}Ni_{18}Cu_9$, copper oxide, and a solid solution of two or three metals nickel, aluminium and copper. It is believed that the surface of this material and materials like it contain non-stoichiometric conductive oxides wherein lattice vacancies are occupied by the metals, providing an outstanding conductivity while retaining the property of ceramic oxides to resist oxidation.

Doping elements such as chromium, manganese, titanium, molybdenum, cobalt, zirconium, niobium, yttrium and cerium may be present in solid solution or as intermetallic compounds.

The in-situ formed composite oxide surface comprises an iron-rich relatively dense outer portion, and an aluminate-rich relatively porous inner portion which integrate into the porous structure of the substrate. Analysis of specimens has shown that between the iron-rich outer portion and the aluminate-rich inner portion is an aluminium-depleted intermediate portion comprising predominantly oxides of nickel and iron.

The outermost iron-rich oxide layer is a homogeneous, dense layer usually comprising oxides of aluminium, iron and nickel with predominant quantities of iron, preferably mainly nickel ferrite doped with aluminium.

The aluminium-depleted intermediate oxide layer usually comprises oxides of nickel and iron, with nickel highly predominant, for example iron-doped nickel oxide which provides good electrical conductively of the anode and good resistance to dissolution during electrolysis.

The underneath aluminate-rich oxide layer is slightly more porous that the two preceding oxide layers and is an oxide of aluminium, iron and nickel, with aluminium highly predominant. This aluminate rich layer may be a homogeneous phase or aluminium oxide with iron and nickel in solid solution, and usually comprises mainly iron nickel aluminate.

The porous metal substrate close to the oxide layer consists of nickel with small quantities of copper, iron and aluminium. It is largely depleted in aluminium as the aluminium is used to create the aluminate layer on top of it, and is also depleted in iron. The metallic and intermetallic core deeper inside the substrate is also depleted of aluminium as a result of internal oxidation in the open pores of the material and diffusion of the oxidised aluminium.

The metallic and intermetallic core (deep down in the sample) has a similar composition to the metallic core nearer the oxide surface.

Interconnecting pores in the metal substrate may be filled with cryolite by penetration during formation of the oxide layer, but the penetrated material becomes sealed off from the electrolyte by the dense oxide coating and does not lead to corrosion inside the anode.

The invention also provides a metal of manufacturing an anode for the production of aluminium by the electrolysis of alumina in a molten fluoride electrolyte, comprising reacting a combustion synthesis reaction mixture of particulate nickel, aluminium and iron or of particulate nickel, aluminium, iron and copper (and optional doping elements such as chromium, manganese, titanium, molybdenum, cobalt, zirconium, niobium, yttrium, cerium, oxygen, boron and nitrogen) to produce a combustion synthesis product which has a porous structure comprising metallic and intermetallic phases, and then anodically polarizing the combustion synthesis product in a molten fluoride electrolyte containing dissolved alumina to produce an in-situ formed composite oxide surface comprising an iron-rich relatively dense outer portion, and an aluminate-rich relatively porous inner portion.

Another aspect of the invention is a method of electrowinning aluminium by the electrolysis of alumina in a molten fluoride electrolyte. The electrowinning method comprises providing a starter anode which is a porous combustion synthesis product comprising metallic and intermetallic phases produced by reacting a combustion synthesis reaction mixture of particulate nickel, aluminium and iron or particulate nickel, aluminium, iron and copper, and anodically polarizing it in a molten fluoride electrolyte containing dissolved alumina to produce an in-situ formed composite oxide surface comprising an iron-rich relatively dense outer portion and an aluminate-rich relatively porous inner portion. Electrolysis of the same or a different molten fluoride electrolyte containing dissolved alumina is then continued to produce aluminium using the in-situ oxidised starter anode.

In principle the final stage of production of the anode will be performed in situ in the aluminium production cell during production of aluminium. However, for special applications, it is possible to form the in situ oxide layer in a special electrolytic cell and then transfer the anode to a production cell.

A coating may be applied to the in-situ formed oxide layer; a preferred coating being in-situ formed cerium oxyfluoride according to U.S. Pat. No. 4,614,569. The cerium oxyfluoride may optionally contain additives such as compounds of tantalum, niobium, yttrium, praesodymium and other rare earth elements, this coating being maintained by the addition of cerium and possibly other elements to the molten cryolite electrolyte. Production of such a protective coating in-situ leads to dense and homogeneous cerium oxyfluoride.

DETAILED DESCRIPTION

The invention will be further described in the following examples.

EXAMPLE 1

A powder mixture was prepared from 73 wt % (68 atomic %) nickel, −100 mesh (<149 micrometer), 6 wt % (12 atomic %) aluminium, −325 mesh (<42 micrometer), 11 wt % (11 atomic %) iron, 10 micrometers particle size, and 10 wt % (9 atomic %) copper, 5–10 micrometers particle size. After mixing, the dry mixture (i.e. without any liquid binder) was uniaxially pressed at a pressure of 176 MPa for a holding time of 3 minutes.

The pressed samples were then ignited in a furnace at 900° C. to initiate a micropyretic reaction in air.

All reacted specimens were inhomogeneous and semi-porous. Analysis of the specimens showed the following composition in atomic %: 59.8% nickel, 18.6% aluminium, 11.2% iron and 10.5% copper at the surface and 62.8% nickel, 13.9% aluminium, 12.3% iron, and 11.0% copper in the core. The intermetallic compound $NiAl_3$ was present.

Some specimens were then subjected to an oxidizing treatment in air at 1000° C. for several hours, typically 5 hours. Other specimens were not subjected to this oxidizing treatment, and it has been found that the oxidizing treatment is neither necessary nor preferred.

The specimens were then used as anodes in a cryolite-based electrolyte containing 7 wt % alumina and 1 wt % cerium fluoride at 980° C. A typical test for a specimen with an anode surface area of 22.4 $cm^2$ ran for a first period of 48 hours at a current density of 0.3 $A/cm^2$, followed by a second period of 54 hours at a current density of 0.5 $A/cm^2$. During the first period, the cell voltage was from 2.9 to 2.5 Volts, and during the second period the cell voltage was from 3.3 to 4.4 Volts. At the end of the test, the anode specimens were removed. The specimens showed no signs of dimensional change, and the metallic substrate of dense appearance was covered by a coarse, dense, uniform and well adhering layer of cerium oxyfluoride.

After the electrolytic test, the specimens were examined by scanning electron microscope and energy dispersive spectroscopy (SEM/EDS).

The cerium oxyfluoride coating appeared homogeneous and very dense, with no apparent porosity. On the surface of the specimen, below the cerium oxyfluoride coating, there was an in-situ formed complex oxide layer, total thickness about 300 micrometers, made up of three different oxide layers.

The outermost oxide layer was a homogeneous, dense oxide-only layer devoid of fluoride. This oxide layer comprised oxides of nickel, aluminium and iron with predominant quantities of iron. The quantities of metals present in atomic % were 32% nickel, 21% aluminium, 45% iron and 2% copper. It is believed that this phase comprises nickel ferrite doped with aluminium.

The intermediate oxide layer was composed of large grains which interpenetrated with the outermost layer. Analysis showed no detectable fluoride, and the intermediate oxide layer comprised oxides of nickel and iron, with nickel highly predominant. The quantities of metals present in atomic % were 83% nickel, 3% aluminium, 13% iron and 1% copper. It is believed that this phase is iron-doped nickel oxide with would explain the good electrical conductivity of the anode and its resistance to dissolution during electrolysis.

The underneath oxide layer was slightly more porous than the two preceding oxide layers. Analysis identified it is an oxide of nickel, aluminium and iron with aluminium highly predominant. A small quantity of fluoride was detected in the pores. The quantities of metals present in atomic % were 22.6% nickel, 53.87% aluminium, 21.54% iron and 1.99% copper. It is believed that this phase may be a homogeneous phase of aluminium oxide with iron and nickel in solid solution, forming an aluminate rich layer such as an iron nickel aluminate.

The porous metal substrate in contact with the oxide layer is comprised of nickel with small quantities of copper, iron and aluminium. It is largely depleted in aluminium as the aluminium is used to create the aluminate layer on top of it. Its composition in atomic % was 77.8% nickel, 5.3% aluminium, 3.5% iron and 13.5% copper.

The metallic core deeper inside the substrate is also depleted of aluminium as a result of internal oxidation in the open pores of the material and diffusion of the oxidised aluminium. Here, the composition in atomic % was 77.2% nickel, 1.8% aluminium, 9.7% iron and 11.3% copper.

All interconnecting pores in the metal substrate are filled with cryolite, and in some cryolite-filled pores, a second phase identified as aluminium fluoride is seen, probably resulting from phase separation during the cooling of the cryolite within the sample. No other metallic fluorides were detected in the metallic core.

The metallic core (deep down in the sample) has a similar composition to the metallic core nearer the oxide surface.

EXAMPLE 2

The procedure of Example 1 was repeated varying the proportions in the starting mixture, as shown in Table I. The resulting specimens were subjected to electrolytic testing as in Example 1. For the first five specimens, the results were very good, and for the last two specimens the results were good.

TABLE 1

| Ni wt % | Al wt % | Fe wt % | Cu wt % | TEST |
|---|---|---|---|---|
| 76.1 | 4.9 | 10 | 10 | VERY GOOD |
| 71.4 | 3.6 | 15 | 10 | |
| 62 | 8 | 20 | 10 | |
| 79 | 10 | 11 | 0 | |
| 66.4 | 3.6 | 15 | 15 | |
| 64 | 6 | 15 | 15 | GOOD |

TABLE 1-continued

| Ni wt % | Al wt % | Fe wt % | Cu wt % | TEST |
|---|---|---|---|---|
| 71 | 8 | 11 | 10 | |

EXAMPLE 3

The procedure of Example 1 was repeated varying the proportions in the starting mixture and with chromium as an extra component. The particle size of the chromium was −325 mesh (<42 micrometer). The composition was nickel 73 wt %, aluminium 6 wt %, iron 6 wt %, copper 10 wt % and chromium 5 wt %. Good results were obtained.

COMPARATIVE EXAMPLE

Anode samples were made from nickel-aluminium-iron-copper alloys prepared by arc-welding in argon. The specimens were dense, non-porous and had the following compositions in atomic %: 58.75% nickel, 23.17% aluminium, 9.19% iron, 8.94% copper; and 61.70% nickel, 14.86% aluminium, 11.69% iron, 10.7% copper. Each sample was oxidized for 5 hours in air.

The two samples were then tested as anodes in the same conditions as in Example 1 at a current density of 0.3 A/cm$^2$ for a period of 30 hours and 17 hours, respectively.

Both anodes were badly corroded at the end of their test period. The reason the anodes did not perform well during testing is probably a result of the mismatch in thermal expansion between the oxide layer and the metallic substrate. These differences in thermal expansion coefficients allow cracks to form in the oxide layer, or the complete removal of the oxide layer, which induces corrosion of the anode by penetration of the bath materials.

The porous anodes according to the invention, however, accommodate the thermal expansion, leaving the protective oxide layer intact, forming a barrier to further penetration by the bath components. Bath materials which penetrate the porous metal during formation of the oxide layer become sealed off from the electrolyte and do not lead to corrosion.

We claim:

1. An anode for the electrowinning of aluminium by the electrolysis of alumina dissolved in a molten fluoride electrolyte, comprising:

a porous combustion synthesis product of particulate nickel, aluminium and iron, or particulate nickel, aluminium, iron and copper, containing metallic and intermetallic phases, and an in-situ formed composite oxide surface produced by anodically polarizing the combustion synthesis product in a molten fluoride electrolyte containing dissolved alumina, said in-situ formed composite oxide surface comprising an iron-rich relatively dense outer portion, and an aluminate-rich relatively porous inner portion.

2. The anode of claim 1, wherein the combustion synthesis product is produced from particulate nickel, aluminium, iron and copper in the amounts 60–90 wt % nickel, 3–10 wt % aluminium, 5–20 wt % iron, 0–15 wt % copper and 0–5 wt % of at least one element from the group consisting of chromium,, manganese, titanium, molybdenum, cobalt, zirconium, niobium, yttrium, cerium, oxygen, boron and nitrogen.

3. The anode of claim 1, wherein the combustion synthesis product is produced from 60–67 wt % nickel, 3–10 wt % aluminium, 5–20 wt % iron and 5–15 wt % copper.

4. The anode of claim 1, wherein the combustion synthesis product comprises at least one ordered intermetallic compound from the group consisting of nickel-iron, nickel-aluminium, aluminium-iron, nickel-aluminium-copper and nickel-aluminium-iron-copper containing intermetallic compounds.

5. The anode of claim 1, wherein the outer portion of the composite oxide surface comprises mainly nickel ferrite doped with aluminium and the inner portion of the composite oxide surface comprises mainly iron-nickel aluminate.

6. The anode of claim 1, wherein the composite oxide surface comprises, between the iron-rich outer portion and the aluminate-rich inner portion, an aluminium-depleted intermediate portion.

7. The anode of claim 6, wherein the aluminium-depleted intermediate portion of the oxide surface comprises predominantly oxides of nickel and iron.

8. The anode of claim 1, wherein the unoxidised part of the combustion synthesis product adjacent to said aluminate-rich inner portion of the oxide surface is depleted in aluminium.

9. The anode of claim 1, wherein the unoxidised part of the combustion synthesis product adjacent to said aluminate-rich inner portion of the oxide surface is depleted in iron.

10. The anode of claim 1, wherein the composite oxide surface is coated with a coating of cerium oxyfluoride.

11. The anode of claim 1, wherein the combustion syntheis product is produced by initiating combustion synthesis of particulate nickel, aluminium, iron or particulate nickel, aluminium, iron and copper, wherein the particulate nickel has a large particle size than the particulate aluminium, iron and copper.

12. A method of manufacturing the anode of claim 1, comprising the steps of:

reacting a combustion synthesis reaction mixture of particulate nickel, aluminium and iron or of particulate nickel, aluminium, iron and copper to produce a porous combustion synthesis product containing metallic and intermetallic phases; and anodically polarizing the combustion synthesis product in a molten fluoride electrolyte containing dissolved alumina to produce an in-situ formed composite oxide surface comprising an iron-rich relatively dense outer portion, and an aluminate-rich relatively porous inner portion.

13. The method of claim 12, wherein the particulate nickel has a larger particle size than the particulate aluminium, iron and copper.

14. The method of claim 12, wherein the in-situ composite oxide surface is formed in a molten cryolite electrolyte containing dissolved alumina and cerium, and an in-situ cerium oxyfluoride coating is simultaneously formed on the composite oxide surface.

15. A method of electrowinning aluminium by the electrolysis of alumina in a molten fluoride electrolyte, comprising the step of:

electrolyzing said molten fluoride electrolyte containing dissolved alumina to produce aluminium in an aluminium production cell using the anode of claim 1.

* * * * *

UNITED STATES PATENT AND TRADEMARK OFFICE

CERTIFICATE OF CORRECTION

PATENT NO. : 5,510,008

DATED : April 23, 1996

INVENTOR(S) : Sekhar et al.

It is certified that error appears in the above-indentified patent and that said Letters Patent is hereby corrected as shown below:

On title page, under "Primary Examiner, and before the item [57], please insert: --Attorney, Agent or Firm - Dinsmore & Shohl--.

Signed and Sealed this

Seventeenth Day of September, 1996

*Attest:*

Bruce Lehman

BRUCE LEHMAN

*Attesting Officer*

*Commissioner of Patents and Trademarks*